US009050612B2

(12) United States Patent
Miller et al.

(10) Patent No.: US 9,050,612 B2
(45) Date of Patent: Jun. 9, 2015

(54) SHOWER DEVICE WITH INDEPENDENTLY OPERATING VALVES

(75) Inventors: Michael A. Miller, Portage, MI (US); Julian Giggs, Hillsdale, MI (US); Lizhong Liao, Xiamen (CN); Shengjun Du, Xiamen (CN)

(73) Assignee: Delta Faucet Company, Indianapolis, IN (US)

( * ) Notice: Subject to any disclaimer, the term of this patent is extended or adjusted under 35 U.S.C. 154(b) by 1616 days.

(21) Appl. No.: 12/407,136

(22) Filed: Mar. 19, 2009

(65) Prior Publication Data

US 2010/0237160 A1 Sep. 23, 2010

(51) Int. Cl.

| | |
|---|---|
| ***A62C 37/20*** | (2006.01) |
| ***B05B 1/18*** | (2006.01) |
| ***B05B 1/16*** | (2006.01) |

(52) U.S. Cl.

CPC ..... *B05B 1/18* (2013.01); *B05B 1/1681* (2013.01)

(58) Field of Classification Search

CPC ..... B05B 1/1681; B05B 1/18
USPC ..... 239/562–564, 443–447
See application file for complete search history.

(56) References Cited

U.S. PATENT DOCUMENTS

| | | | | |
|---|---|---|---|---|
| 1,200,972 | A * | 10/1916 | Passmann | 239/444 |
| 2,357,973 | A | 9/1944 | Robbins | |
| 2,949,240 | A | 8/1960 | Koolnis | |
| 4,026,025 | A | 5/1977 | Hunt | |
| 4,031,348 | A | 6/1977 | Eberhardt | |
| 4,227,878 | A | 10/1980 | Lohn | |
| 4,344,457 | A | 8/1982 | Caroli | |
| 4,801,091 | A | 1/1989 | Sandvik | |
| 4,965,894 | A | 10/1990 | Baus | |
| 4,980,522 | A | 12/1990 | Murakami et al. | |
| 5,109,553 | A | 5/1992 | Kishimoto | |
| 5,169,072 | A | 12/1992 | Gulyas | |
| 5,199,639 | A | 4/1993 | Kobayashi et al. | |
| 5,199,871 | A | 4/1993 | Young | |
| 5,305,476 | A | 4/1994 | Ohyama et al. | |
| 5,413,358 | A | 5/1995 | Austin, Jr. et al. | |
| 5,546,983 | A * | 8/1996 | Clare | 137/607 |
| 5,658,144 | A | 8/1997 | Tinder et al. | |
| 5,918,816 | A | 7/1999 | Huber | |
| 5,961,051 | A | 10/1999 | Matsui et al. | |
| 6,227,456 | B1 * | 5/2001 | Colman | 239/1 |
| 6,264,121 | B1 | 7/2001 | McClary | |
| 6,283,221 | B2 | 9/2001 | Hurray et al. | |
| 6,299,035 | B1 | 10/2001 | Dalhart | |
| 6,322,005 | B1 | 11/2001 | Kern et al. | |
| 6,437,267 | B1 | 8/2002 | Imai | |
| 6,500,169 | B1 | 12/2002 | Deng | |
| 6,527,203 | B2 | 3/2003 | Hurray et al. | |
| 6,715,699 | B1 | 4/2004 | Greenberg et al. | |
| 6,892,952 | B2 | 5/2005 | Chang et al. | |

(Continued)

FOREIGN PATENT DOCUMENTS

| | | |
|---|---|---|
| DE | 3506078 | 8/1986 |
| DE | 4204308 | 8/1993 |

(Continued)

*Primary Examiner* — Christopher Kim

(74) *Attorney, Agent, or Firm* — Carlson, Gaskey & Olds, PC

(57) ABSTRACT

A shower device includes spray outlets and valves configured to control flow of a fluid to the spray outlets. At least one of the valves is configured to control, independently of other valves, flow of the fluid to at least one of the spray outlets.

12 Claims, 10 Drawing Sheets

(56) References Cited

U.S. PATENT DOCUMENTS

| | | | |
|---|---|---|---|
| 2001/0001985 | A1 | 5/2001 | Hurray et al. |
| 2002/0038826 | A1 | 4/2002 | Hurray et al. |
| 2002/0158143 | A1 | 10/2002 | Moriarty et al. |
| 2006/0208104 | A1 | 9/2006 | DeBoer et al. |
| 2007/0119989 | A1 | 5/2007 | Nagano et al. |
| 2007/0158460 | A1 | 7/2007 | Lev |

FOREIGN PATENT DOCUMENTS

| | | |
|---|---|---|
| EP | 235487 | 9/1987 |
| EP | 0510184 B1 | 8/1995 |
| FR | 2683745 | 5/1993 |
| JP | 5300845 | 11/1993 |
| JP | 6108504 | 4/1994 |
| JP | 6116995 | 4/1994 |
| JP | 6173385 | 6/1994 |

* cited by examiner

SHOWER DEVICE WITH INDEPENDENTLY OPERATING VALVES

BACKGROUND OF THE INVENTION

This disclosure relates to shower devices and, more particularly, to a shower device and method for controlling a spray pattern from spray outlets of the shower device.

Many shower devices contain a single set of spray outlets in a specific configuration to provide a desired spray pattern. Other shower devices are adjustable to provide different spray patterns, depending on preferences of a user. One such shower device includes a shower head having multiple spray outlets arranged on a face plate and a water supply passage, to control flow of water to the spray outlets. A user may turn a dial on the shower head to divert water to sections of the spray outlets to provide a desired spray pattern.

Although effective, such shower devices are typically limited to a few spray patterns provided by the multiple outlets on the face plate. Thus, the manufacturer pre-selects the spray patterns for a user to choose from, and the user has no ability to adjust the given spray patterns based upon their own preferences.

SUMMARY OF THE INVENTION

An example shower device includes spray outlets and valves configured to control flow of a fluid to the spray outlets. At least one of the valves is configured to control, independently of other valves, flow of the fluid to at least one of the spray outlets.

In another aspect, a shower device includes operable valves, and actuation of any one of the operable valves causes that operable valve to unlock from a locked state, move from a first position or a second position to, respectively, the second position or the first position, and then relock to the locked state.

An example method of controlling a shower device includes selectively actuating valves that are configured to control flow of a fluid to spray outlets of the shower device. Each of the valves is configured to control the flow of the fluid to at least one of the spray outlets, independently of other ones of the valves.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1A:
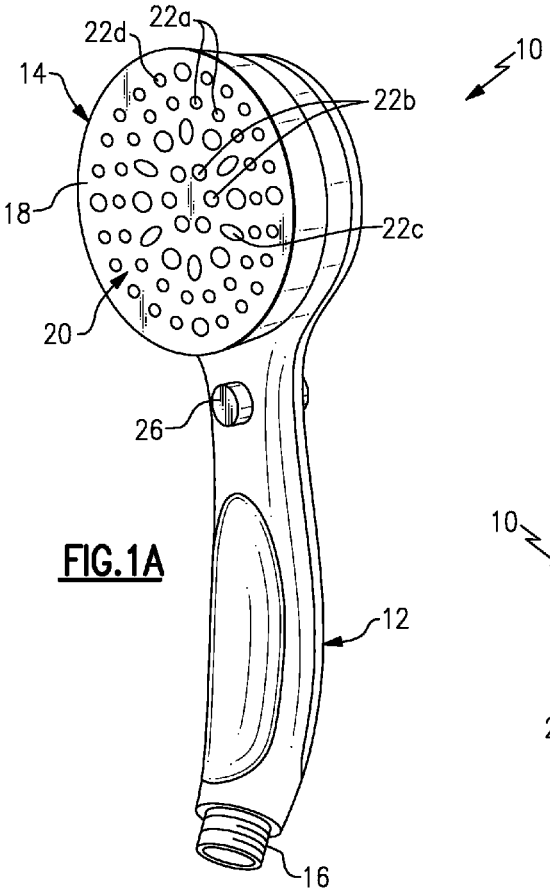
FIG. 1A illustrates a front view of an example shower device.
Figure 1B:
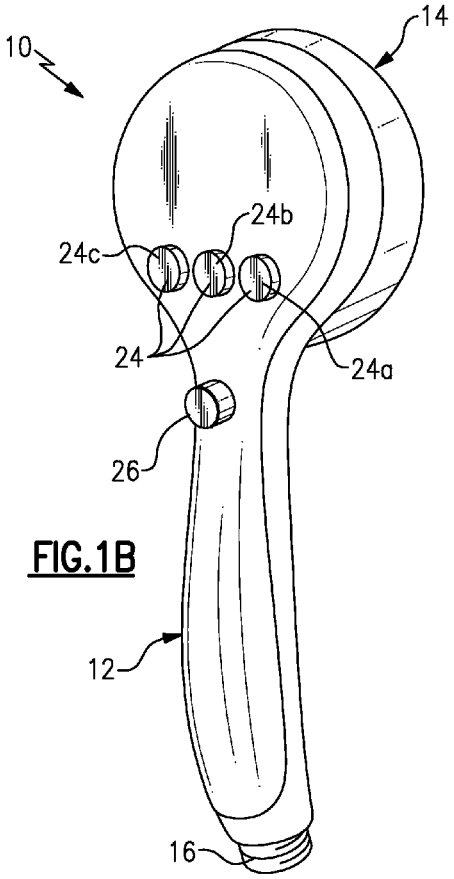
FIG. 1B illustrates a rear view of the shower device shown in FIG. 1A.

FIG. 1A illustrates selected portions of an example shower device 10 from a front view, and FIG. 1B illustrates the shower device 10 from a rear view. In the illustrated example, the shower device 10 generally includes a handle 12 for manipulating the shower device 10 and a head 14 for spraying a fluid, such as liquid water. The handle 12 may include an inlet 16 for receiving the fluid, and the head 14 includes a face 18 having a plurality of spray outlets 20. Alternatively, the shower device 10 may not include the handle 12 and may be adapted with the inlet 16 directly in the head 14 for relatively permanent fixation to a water pipe in a shower. It is to be understood that the disclosed examples are not limited to the particular design of the shower device 10 shown.

The term "spray outlets" is not intended to refer to any particular type of outlet and may include, for example only, one or more spray nozzles, fluidic nozzles, or other arrangements for emitting the fluid from the shower device 10. Additionally, it is to be understood that the spray outlets may not exclusively discharge the fluid. That is, another fluid may be added into the shower device 10 (e.g., mixed with the first fluid) prior to discharge from the spray outlets 20.

The spray outlets 20 may include groupings (i.e., a first group, a second group, etc.) of spray outlets. As an example, the spray outlets 20 may include spray outlets 22*a* that are outermost outlets 22*a*, spray outlets 22*b* that are innermost outlets 22*b*, spray outlets 22*c* that are intermediate outlets 22*c*, and spray outlets 22*d* that are bypass outlets 22*d*. Each group of spray outlets 22*a-d* is generally circumferentially oriented and concentric with respect to each other. It is to be understood that the disclosed example arrangement of the spray outlets 20 may vary from that shown and need not be circumferentially oriented.

The shower device 10 includes valves 24, such as valves 24*a*, 24*b*, and 24*c*, in selective fluid connection with the inlet 16 for controlling flow to the spray outlets 22*a-c*. The valves 24 may be any type of valve capable of controlling flow, such as on/off valves, diverter valves, ratchet valves, rotary valves, geared valves, rocker valves, etc. At least one of the valves 24 is configured to control, independently of the other valves 24, flow to at least one of the spray outlets 20 (i.e., one of the groups of spray outlets 22*a-c*). An individual valve 24 is considered independent if the control of the flow from the respective valve 24 does not rely on a state of another of the valves 24. For instance, the valve 24*a* can provide flow to the corresponding spray outlet 22*a* whether or not valves 24*b* and 24*c* are in an open, closed, or other state. Likewise, valves 24*b* and 24*c* are independent valves in this example.

As may be appreciated, additional valves 24 may be used in other examples to control spray of other groups of spray outlets. The bypass spray outlets 22*d* may be directly connected to the inlet 16 such that the shower device 10 always discharges spray from the bypass spray outlets 22*d*. Optionally, the shower device 10 may also include a flow-control valve 26 upstream of the valves 24 for controlling flow of the fluid to the valves 24 and/or spray outlets 20. The flow-control valve 26 may be capable of completely blocking flow to the valves 24 and spray outlets 20 or, alternatively, may only reduce the flow such that there is always some flow to at least a portion of the valves 24 or a portion of the spray outlets 20. In another alternative, the flow-control valve 26 may have multiple positions, such as a diverter, for controlling flow to individual ones of the valves 24 or to portions of the spray outlets 20.

Figure 1C:
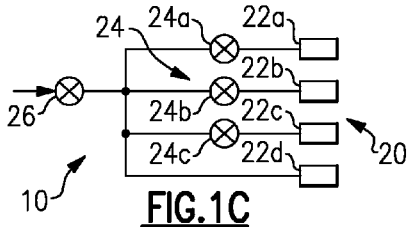
FIG. 1C schematically illustrates a portion of the shower device of FIG. 1A.

FIG. 1C schematically illustrates a portion of the shower device 10 as a circuit-type diagram. A user may independently operate the valves 24 to control a spray pattern from the spray outlets 20. In this case, each of the valves 24 controls flow independently of the other valves 24. For instance, valve 24*a* may control flow of the fluid to the spray outlets 22*a*, the valve 24*b* may control flow of the liquid to the spray outlets 22*b*, and the valve 24*c* may control flow of the liquid to the spray outlets 22*c*. That is, each of the valves 24*a-c* may be operated to open or close flow of the fluid to the corresponding spray outlets 22*a-c* without regard to whether other valves 24*a-c* are open or closed. Thus, a user may select from a wide variety of spray patterns by actuating different combinations of the valves 24. Additionally, if the flow-control valve 26 is incorporated in the shower device 10, the user may control the intensity of the spray in combination with the different spray patterns available.

FIGS. 1D-K schematically illustrate additional example shower devices 210, 310, 410, 510, 610, 710, 810, and 910 that are variations of the shower device 10. In this disclose, like reference numerals designate like elements where appropriate, and reference numerals with the addition of one-hundred designate modified elements. It is to be understood that the modified elements incorporate the same features and benefits of the corresponding original elements, except where stated otherwise.

Figure 1D:
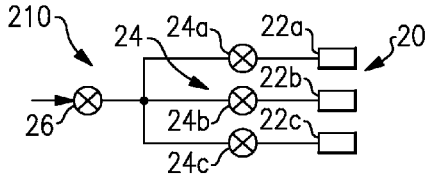
FIGS. 1D-K schematically illustrate additional example shower devices.
Figure 1E:
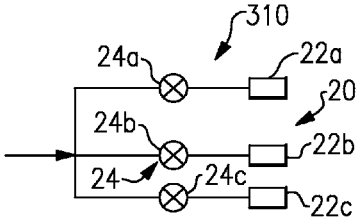
Figure 1F:
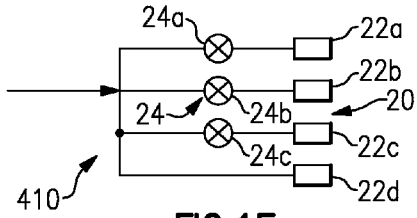
Figure 1G:
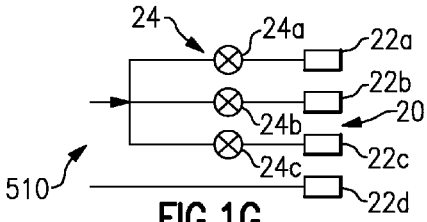

The shower device 210 in FIG. 1D does not include the bypass spray outlets 22*d*. The shower device 310 in FIG. 1E does not include the bypass spray outlet 22*d* or the flow-control valve 26. The shower device 410 in FIG. 1F includes the bypass spray outlet 22*d* but does not include the flow control valve 26. The shower device 510 in FIG. 1G does not include the flow control valve 26 but does include the bypass spray outlet 22*d*, which is connected to a different fluid source than the spray outlets 22*a-c*. In the disclosed examples, the shower devices may be connected to a single source of fluid or multiple sources, such as multiple hoses, corresponding to the respective valves 22*a-c*, for example.

Figure 1H:
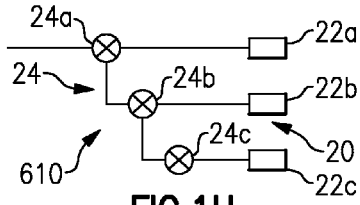

Referring to FIG. 1H, the valves 24 of the shower device 610 are arranged differently than the prior examples. In this case, the valves 24 are arranged in series relative to the flow such that the fluid sequentially flows to valve 24*a*, valve 24*b*, and valve 24*c*. In this regard, valve 24*a* is independent of the valves 24*b* and 24*c* because the flow from valve 24*a* to spray outlet 22*a* does not rely on the state of the valves 24*b* or 24*c*. However, the valves 24*b* and 24*c* are not independent, as the flow from valves 24*b* and 24*c* to respective spray outlets 22*b* and 22*c* is dependent on whether the valve 24*a* is in a state that permits flow to valve 24*b*.

Figure 1I:
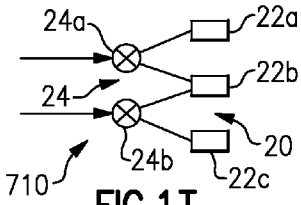

Referring to FIG. 1I, the shower device 710 includes the valves 24*a* and 24*b*. In this case, valve 24*a* independently controls flow to spray outlet 22*a* and valve 24*b* independently controls flow to spray outlet 22*c*. Spray outlet 22*b* is common to both valves 24*a* and 24*b*.

Figure 1J:
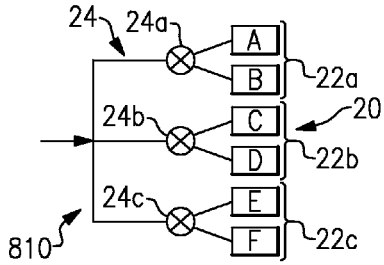

Referring to FIG. 1J, the shower device 810 includes the valves 24*a-c*. In this case, each of the valves 24*a-c* is a diverter valve that controls the flow between sub-groups of outlets (identified as A-F) of the spray outlets 22*a-c*. For instance, valve 24*a* selectively diverts the flow between sub-group A outlets and sub-group B outlets. Likewise, valves 24*b* and 24*c* divert flow between respective sub-groups C and D and sub-groups E and F. As can be appreciated, not all of the valves 24*a-c* need be diverter valves as shown.

Figure 1K:
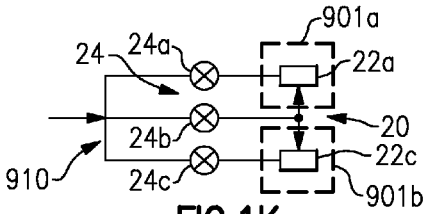

Referring to FIG. 1K, the shower device 910 includes the valves 24*a-c*. In this case, the valve 24*a* controls flow to spray outlet 22*a*, which is located within a first shower head 901*a*. The valve 24*c* controls flow to spray outlet 22*c*, which is located within a second shower head 901*b*. The valve 24*b* controls flow to both spray outlets 22*a* and 22*c*.

Figure 2A:
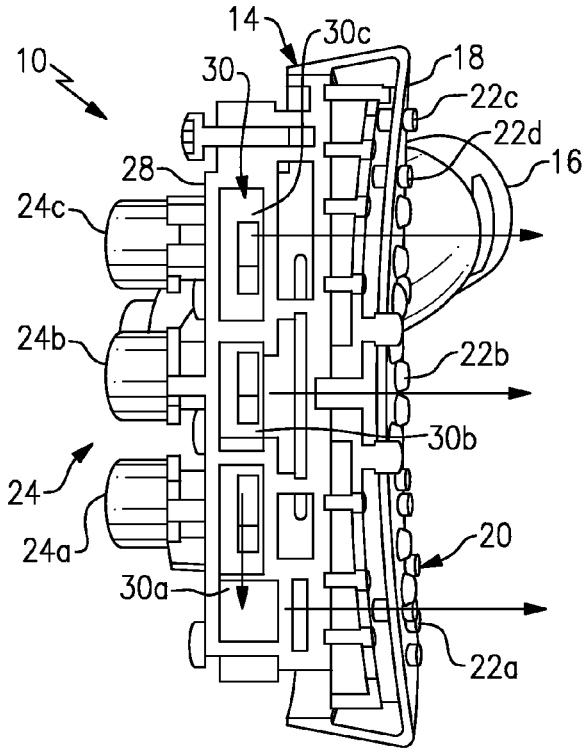
FIG. 2A illustrates a cross-section of the shower device of FIG. 1A showing a plurality of independently operating valves.
Figure 2B:
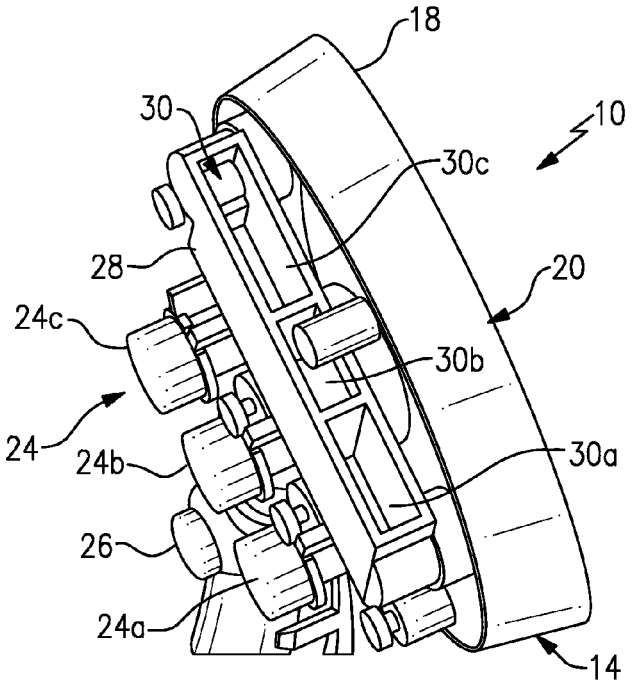
FIG. 2B illustrates a cross-section of a portion of the shower device of FIG. 1A showing a plurality of chambers.
Figure 2C:
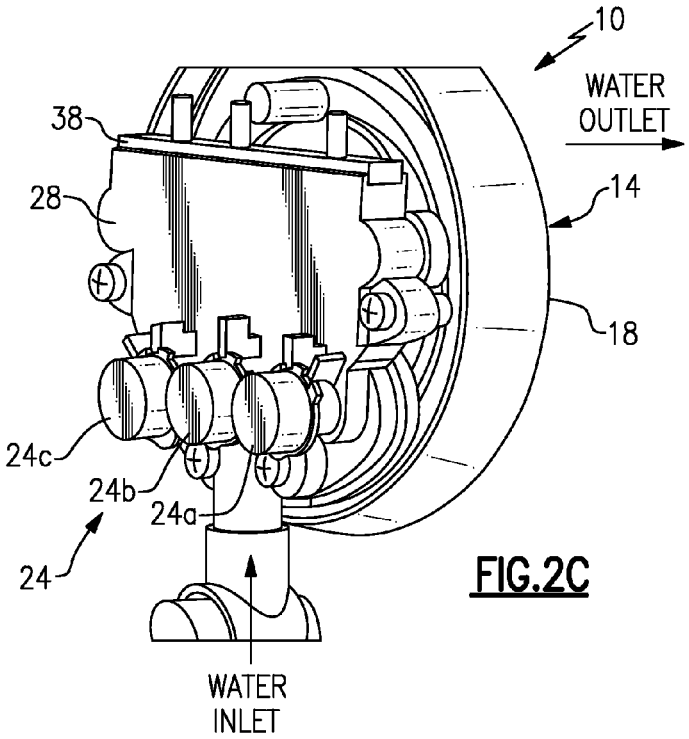
FIG. 2C illustrates a perspective view of the shower device of FIG. 1A showing the independently operating valves.

Although the following examples are made with reference to the shower device 10, it is to be understood that the examples are applicable to the shower devices 210, 310, 410, 510, 610, 710, 810, and 910. FIG. 2A illustrates a cross-section through a portion of the head 14 of the shower device 10. FIG. 2B illustrates a perspective, sectioned view of the head 14, and FIG. 2C illustrates a perspective view inside the head 14 of the shower device 10. Each of the plurality of valves 24 is received at least partially within a valve body 28 that distributes fluid from the plurality of valves 24 to the spray outlets 22*a-c*. For example, the valve body 28 includes a plurality of chambers 30, such as chambers 30*a*, 30*b*, and 30*c* corresponding exclusively to respective valves 24*a*, 24*b*, and 24*c*. The valve body 28 also includes a bypass passage 36 (FIG. 3) for supplying fluid to the bypass spray outlets 22*d* without flow through one of the plurality of valves 24.

The valve body 28 may be formed from a plastic, metal or metal alloy, such as by casting or machining, and then sealed with a cap 38. For instance, the cap 38 may be welded to the valve body 28.

Figure 2D:
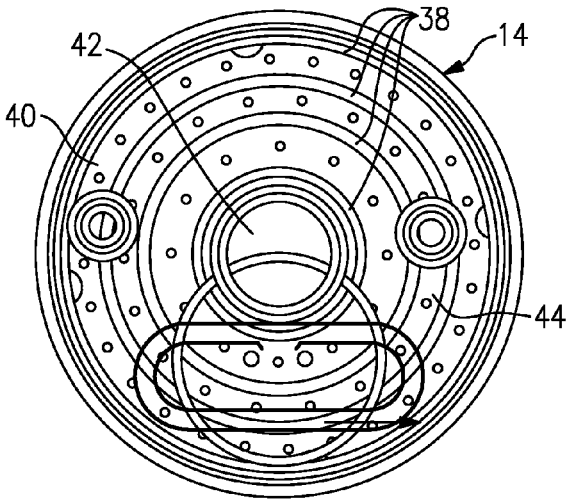
FIG. 2D illustrates the shower device of FIG. 1A without a face to show a connection between the plurality of chambers and spray outlets.

FIG. 2D illustrates the head 14 of the shower device 10 without the face 18 to demonstrate the connection between the plurality of chambers 30 and the spray outlets 22*a-c*. For instance, the head 14 includes circumferential ridges 38 that define a first manifold 40, a second manifold 42, and a third manifold 44 that receive fluid from respective chambers 30*a*, 30*b*, and 30*c* to emit the fluid from respective spray outlets 22*a-c*.

Figure 3:
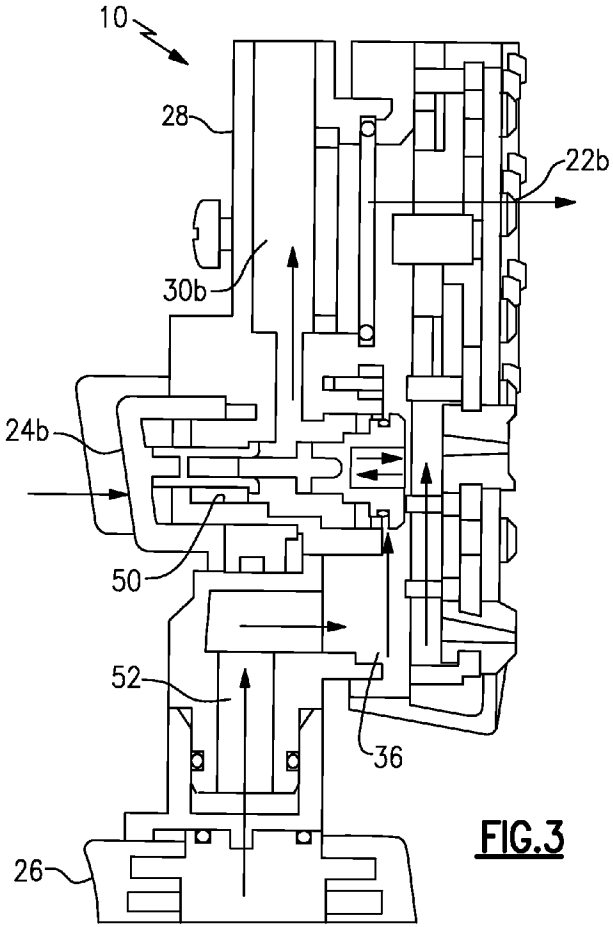
FIG. 3 illustrates another cross-section of the shower device of FIG. 1A showing an example of one of the independently operating valves in an open position.

Referring to FIG. 3, the valve body 28 includes a plurality of valve openings 50 (one shown) for receiving corresponding ones of the plurality of valves 24. In the illustrated example, the shower device 10 is cross-sectioned through valve 24*b*, but the other valves 24*a* and 24*c* are similarly configured. In FIG. 3, the valve 24*b* in an open position that permits flow of the fluid between the inlet 16 and the spray outlets 22*b*. For instance, the fluid flows through the flow-control valve 26 into an inlet passage 52 (as indicated by flow arrows) that is fluidly connected with each of the valves 24. The fluid flows through the valve 24*b*, into corresponding chamber 30*b*, into the second manifold 42, and then from the spray outlets 22*b*.

Figure 4:
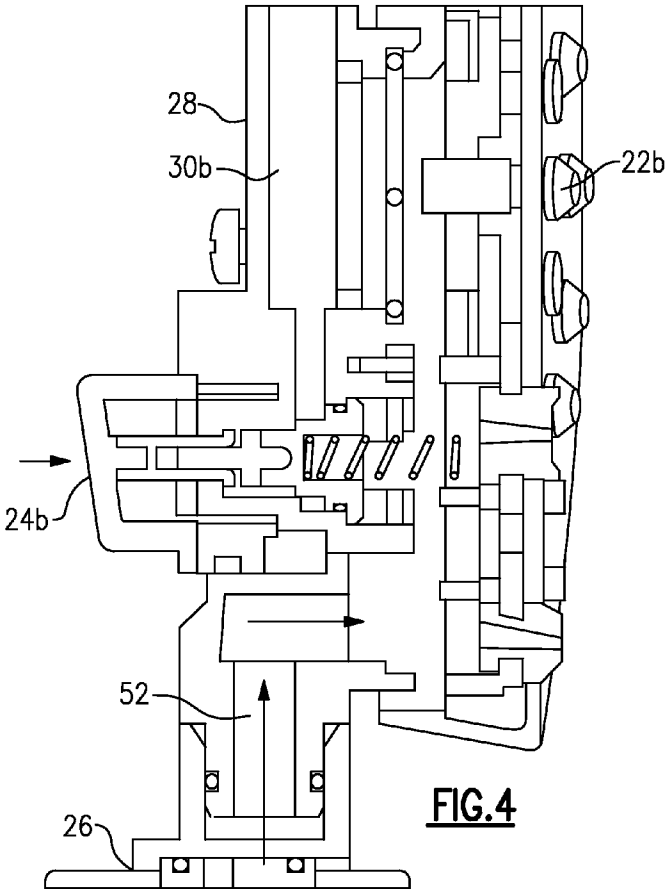
FIG. 4 illustrates another cross-section of the shower device of FIG. 1A showing an example of one of the independently operating valves in a closed position.

FIG. 4 illustrates the valve 24*b* in a closed position that blocks flow of the fluid between the inlet passage 52 and the corresponding chamber 30*b*. In the closed position, no fluid is sprayed from the corresponding spray outlets 22*b*. However, since the inlet passage 52 is also fluidly connected with the valves 24*a* and 24*c*, the spray outlets 22*a* and 22*c* may spray the fluid if the corresponding valves 24*a* and 24*c* are open. That is, the valves 24*a*, 24*b*, and 24*c* operate independently.

Figure 5:
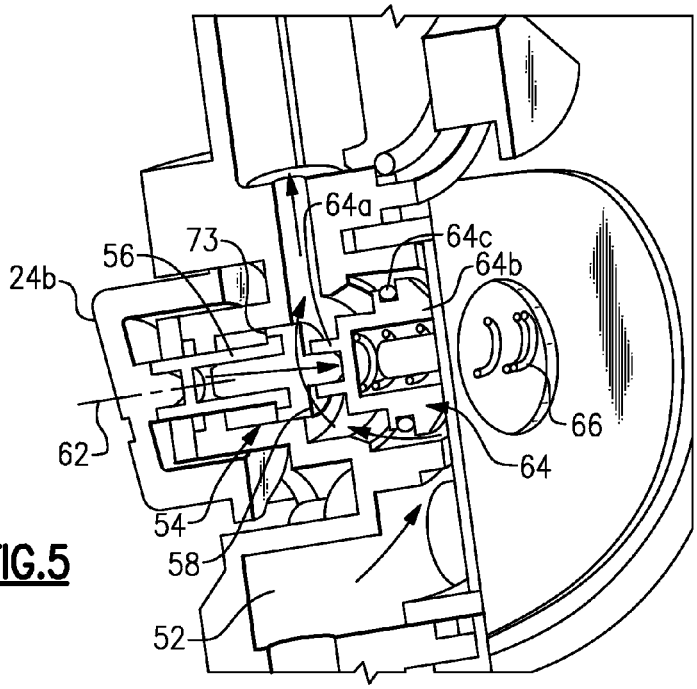
FIG. 5 illustrates a cross-section of an example of one of the independently operating valves.

FIG. 5 illustrates an example of the valve 24*b*, which is also representative of valves 24*a* and 24*c*. In this example, the valve 24*b* is an operable, push-button valve having a push-on/push-off latch 54 for a "one-touch" operation. That is, an actuation of the valve 24*b* (e.g., manual actuation) causes the valve 24*b* to unlock from a locked state, move from a first position or a second position to, respectively, the second position or the first position, and relock to the locked state. For instance, if the valve 24*b* is open, a single actuation unlocks the valve 24*b*, moves the valve 24*b* from the open position to a closed position, and relocks the valve 24*b* in the closed position until there is another actuation. It is to be understood however, that the valves 24*a-c* may vary from the design shown such that the valves 24*a-c* do not necessarily lock in the open or closed state and/or have more than two positions to divert fluid.

Figure 6:
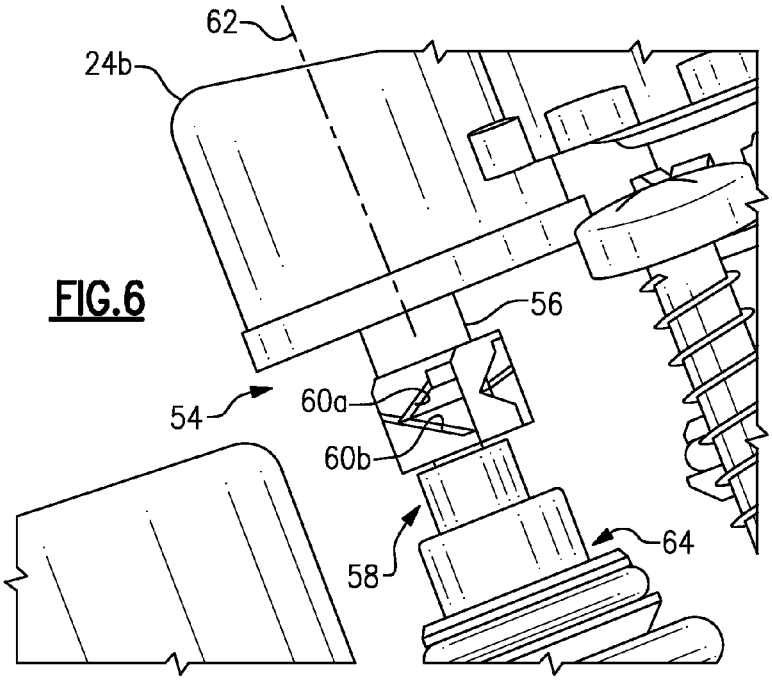
FIG. 6 illustrates a cross-section through a portion of one of the independently operating valves showing sloped camming surfaces.

Referring also to FIG. 6, the push-on/push-off latch 54 includes a cam member 56 and a valve member 58. The cam member 56 includes a sloped camming surface 60*a* and the valve member 58 includes a sloped camming surface 60*b* that cooperates with the sloped camming surface 60*a* to impart rotational motion of the valve 24*b* about a central axis 62 upon an actuation of the valve 24*b*, to achieve the push-on/push-off function. That is, pushing the valve 24*b* moves the valve 24*b* axially along the axis 62 and causes the sloped camming surfaces 60*a* and 60*b* to slide relative to each other and rotate about the central axis 62.

Valve member 58 also includes a valve spool 64 having a narrow end 64*a* for permitting flow of the fluid and wide end 64*b* for blocking the flow of the fluid. The wide end 64*b* includes an o-ring seal 64*c* for facilitating blocking flow in the closed position. A bias member 66, such as a coil spring, biases the valve 24*b* towards a default position. The default position is the closed position.

Figure 7:
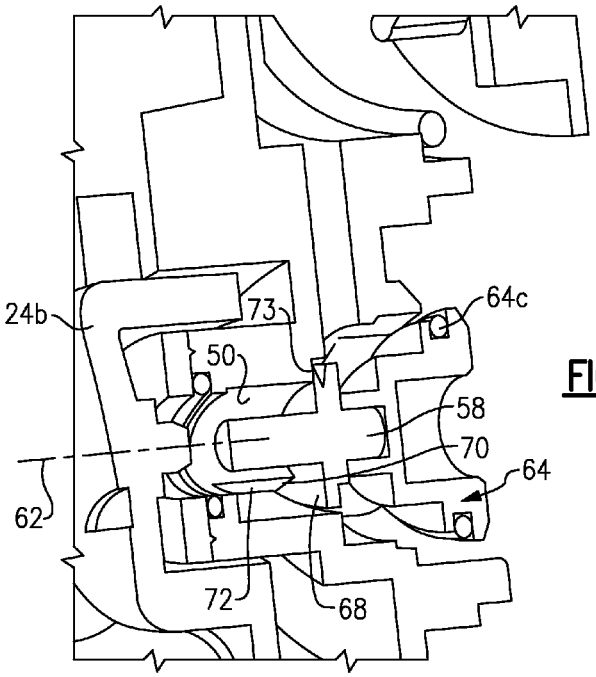
FIG. 7 illustrates a cross-section through a portion of one of the independently operating valves showing a guide rib and guide slot of the valve.
Figure 8A:
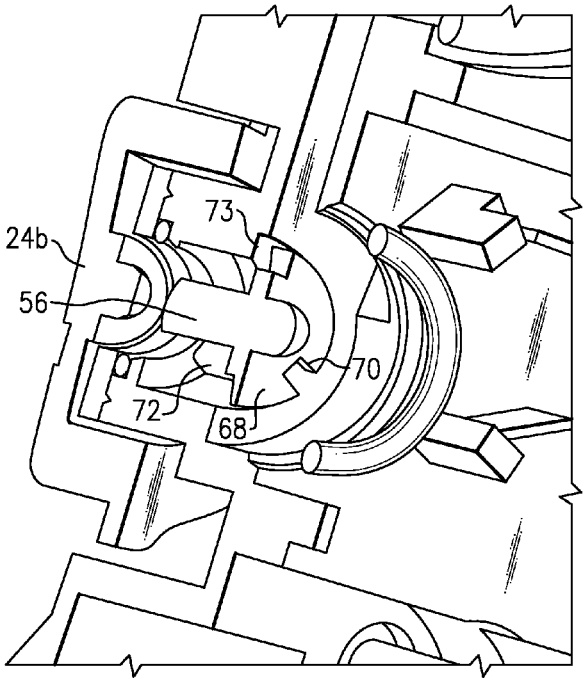
FIG. 8A illustrates a cross-section through a portion of one of the independently operating valves showing operation of the valve.
Figure 8B:
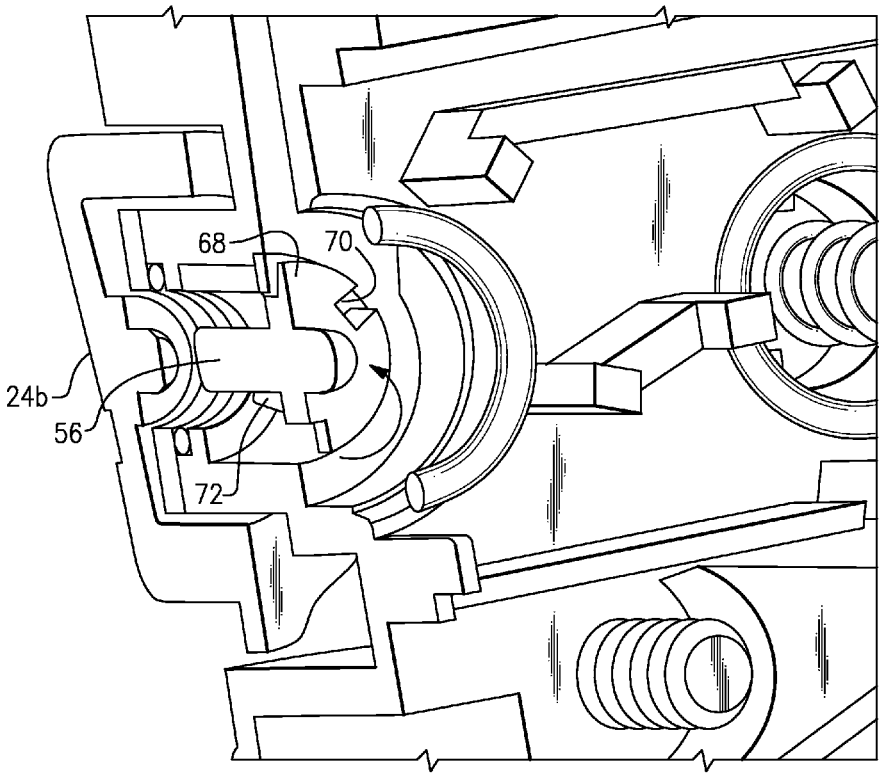
FIG. 8B illustrates a cross-section through a portion of one of the independently operating valves showing rotation of the valve.

As illustrated in FIG. 7, the cam member 56 also includes a flange 68 having a radial slot 70 that interlocks with a rib 72 of the valve opening 50. The valve opening 50 may have several of the ribs 72, and the cam member 56 may have several of the slots 70 interlocked with corresponding ones of the ribs 72. The ribs 72 generally longitudinally extend within the valve opening 50, to guide axial movement of the valve 24*b* along the central axis 62. When the slots 70 are engaged with the ribs 72 as also shown in FIG. 8A, the cam member 56 is not permitted to rotate and simply pushes the valve member 58 axially along the central axis 62 toward the open position. When the flange 68 of the cam member 56 moves past the ends of the ribs 72, the slots 70 disengage from the ribs 72. After disengagement, the cam member 56 is free to rotate through translation along camming surface 60*b* of valve member 58, as shown in FIG. 8B. Rotation of the cam member 56 relative to the valve member 58 misaligns the slots 70 relative to the ribs 72 such that the cam member 56 and the valve member 58 lock in the open position. Another actuation of the valve 24*b* causes the camming surfaces 60*a* and 60*b* to again slide relative to one another and rotate the cam member 56 relative to the valve member 58 such that the slots 70 align with the ribs 72. Once aligned, the bias force provided by the bias member 66 moves the cam member 56 such that the slots 70 again engage the ribs 72 and slide to the closed position blocking flow of the fluid. The force of the bias member 66 then relocks the valve in the closed position (e.g., against abutment 73) until there is another actuation. As may be appreciated, other types of valves may be used instead of or in addition to the valves disclosed herein.

Figure 9:
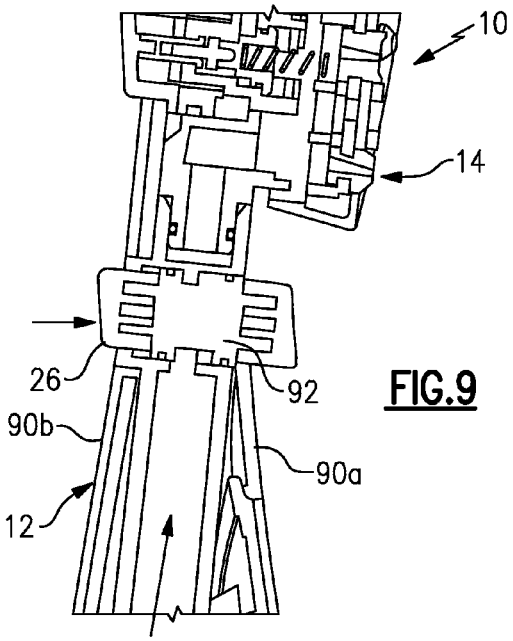
FIG. 9 illustrates a cross-section of a portion of the shower device of FIG. 1A showing a flow-control valve in an open position.
Figure 10:
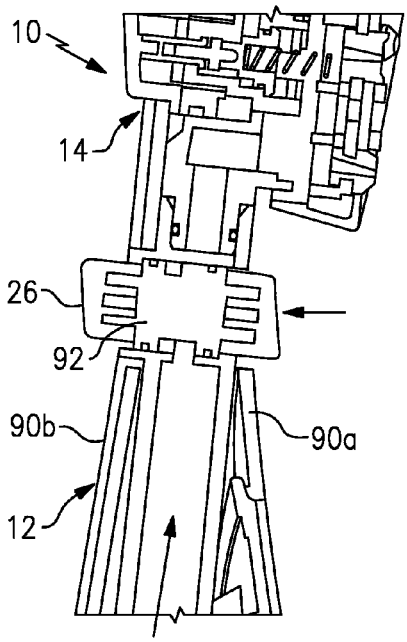
FIG. 10 illustrates a cross-section of a portion of the shower device of FIG. 1A showing the flow-control valve in a closed position.

FIG. 9 illustrates an example of the flow-control valve 26 in the handle 12 of the shower device 10. In this example, the handle 10 includes a first, front side 90*a* and a second, opposite side 90*b*. The flow-control valve 26 is exposed on the front side 90*a* and the opposite side 90*b*. For instance, the flow-control valve 26 includes a valve member 92 that is movable to an open position as illustrated in FIG. 9 by moving the flow-control valve 26 from the back side 90*b* toward the front side 90*a*. The flow-control valve 26 is also exposed on the front side 90*a* and may be moved toward the back side 90*b* to move the valve member 92 to a closed position that blocks flow form the inlet 16 to the head 14 of the shower device 10. The flow control valve 26 may also be actuated to positions in between for an intermediate amount of flow. The flow-control valve 26 may be used in combination with the plurality of valves 24 to provide a desired spray intensity.

Figure 12:
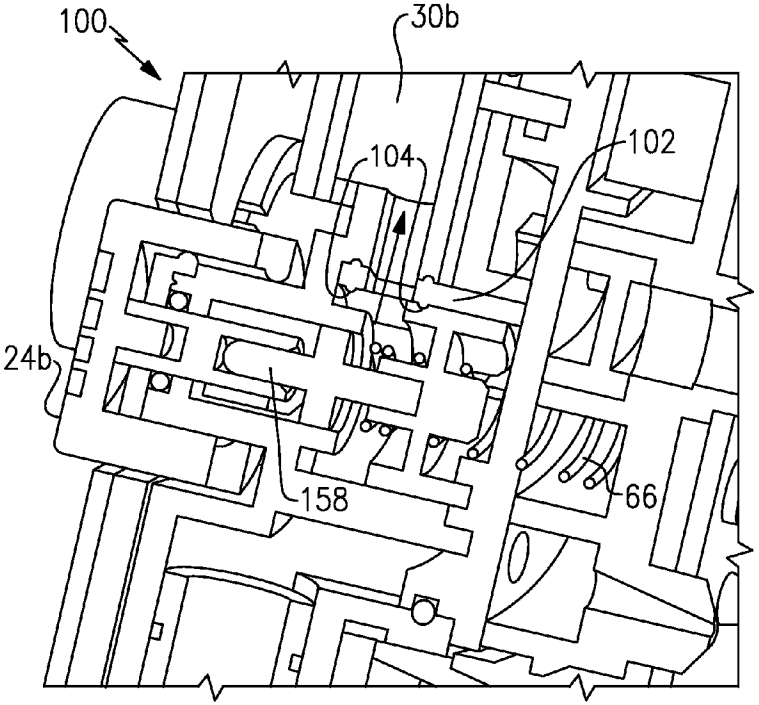
FIG. 12 illustrates an independently operating valve of another example shower device in an open position and including a static seal.
Figure 11:
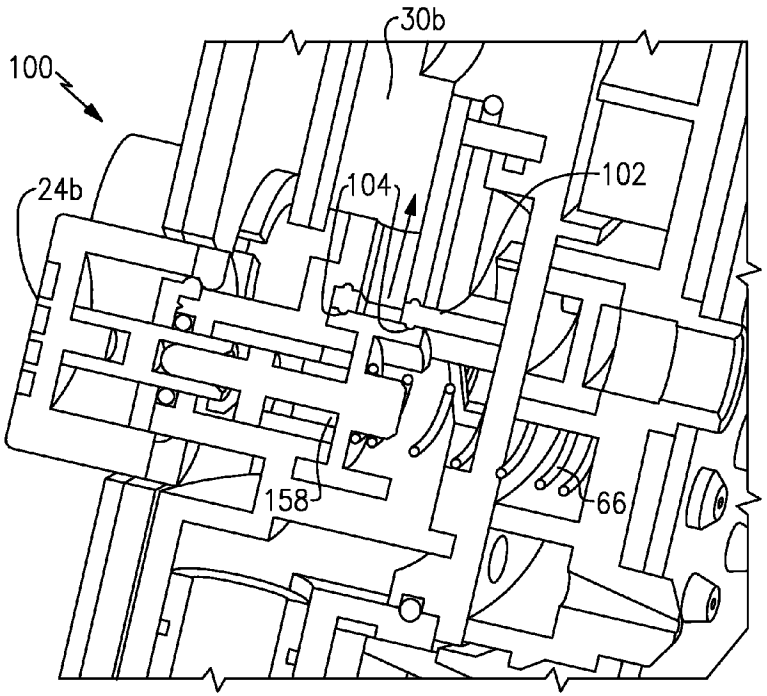
FIG. 11 illustrates an independently operating valve of another example shower device in a closed position and including a static seal.

FIGS. 11 and 12 illustrate a portion of another shower device 100 that is similar to the shower device 10 of the previous examples but includes a static seal 102. In this example, the static seal 102 is located between the corresponding chamber 30*b* and the valve 24*b*. The static seal 102 includes beads 104 that protrude and seal against a valve member 158, which is similar to the valve member 58 of the previous example but does not include the o-ring seal 64*c*. That is, the static seal 102 is used instead of the o-ring seal 64*c* to facilitate blocking the flow of the fluid when the valve 24*b* is moved to the closed position (FIG. 11) from the open position (FIG. 12).

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A hand-held shower, said hand held shower comprising:

a body for attaching to a flexible hose inputting water to said body, said body having outlets on a front side thereof for delivering water to a user, wherein said outlets are formed in a first group, a second group, and a third group, wherein said first group provides a first flow pattern, said second group provides a second flow pattern, and said third group provides a third flow pattern, wherein said first group is controlled by a first valve, said second group is controlled by a second valve and said third group is controlled by a third valve, and wherein said first valve is controlled by a first button disposed on a back side of said body, said second valve is controlled by a second button disposed on said back side of said body, and said third valve is controlled by a third button disposed on said back side of said body.

2. The hand-held shower of claim 1 wherein said first and pattern and said second patterns are different from each other.

3. The hand-held shower of claim 1 wherein each of said first, said second and said third valves operate independently of each other.

4. The hand-held shower of claim 1 wherein said first pattern includes a fourth and a fifth pattern each of said fourth and said fifth patterns being different from each other.

5. The hand-held shower of claim 4 wherein said second pattern includes a sixth and a seventh pattern.

6. The hand-held shower of claim 1 wherein said first valve controls flow to said second valve.

7. The hand-held shower of claim 6 wherein said second valve controls flow to said third valve.

8. The hand-held shower of claim 1 further comprising a fourth group in said body.

9. The hand-held shower of claim 8 wherein said fourth group is not controlled by a fourth valve.

10. The hand-held shower of claim 1 further comprising a fourth valve in said body.

11. The hand-held shower of claim 10 wherein said fourth valve controls flow to said first, second and third valves.

12. The hand-held shower of claim 10 wherein said fourth valve controls flow to a fourth group.

* * * * *